US005773393A

United States Patent [19]

Adams

[11] Patent Number: 5,773,393

[45] Date of Patent: Jun. 30, 1998

[54] OIL COMPOSITIONS USEFUL IN HYDRAULIC FLUIDS

[75] Inventor: Paul Ernest Adams, Willoughby, Ohio

[73] Assignee: The Lubrizol Corporation, Wickliffe, Ohio

[21] Appl. No.: 877,090

[22] Filed: Jun. 17, 1997

Related U.S. Application Data

[63] Continuation of Ser. No. 494,113, Jun. 23, 1995, abandoned, and a continuation of Ser. No. 760,667, Sep. 16, 1991, abandoned.

[51] Int. Cl.[6] ..... C10M 133/16; C10M 133/04

[52] U.S. Cl. ..... 508/551; 508/554; 508/555; 508/558; 508/545

[58] Field of Search ..... 508/551, 554, 508/555, 545

[56] References Cited

U.S. PATENT DOCUMENTS

| | | | |
|---|---|---|---|
| 2,336,006 | 12/1943 | Fuller | 252/51.5 R |
| 2,344,016 | 3/1944 | Anderson | 252/51.5 R |
| 2,403,067 | 7/1946 | Fischer et al. | 252/51 |
| 2,638,449 | 5/1953 | White et al. | 252/51.5 |
| 2,742,432 | 4/1956 | Messing | 252/51.5 R |
| 2,799,659 | 7/1957 | Mayhew et al. | 252/392 |
| 2,892,854 | 6/1959 | Hommer | 260/404 |
| 2,917,160 | 12/1959 | Turinsky | 252/51.5 R |
| 2,967,831 | 1/1961 | Hommer | 252/77 |
| 3,089,854 | 5/1963 | Meyers et al. | 252/49.5 |
| 3,172,892 | 3/1965 | La Suer et al. | 260/326.5 |
| 3,269,999 | 8/1966 | Moore et al. | 260/102 |
| 3,280,029 | 10/1966 | Waldmann | 252/49.5 |
| 3,312,620 | 4/1967 | Low et al. | 252/75.1 |
| 3,368,971 | 2/1968 | Retzloff et al. | 292/33.4 |
| 3,405,064 | 10/1968 | Miller | 252/51.5 |
| 3,429,674 | 2/1969 | Hoke | 44/58 |
| 3,444,170 | 5/1969 | Norman et al. | 260/268 |
| 3,493,512 | 2/1970 | Trites | 252/51.5 R |
| 3,503,891 | 3/1970 | Schimlar | 252/152 |
| 3,541,012 | 11/1970 | Stuebe | 252/51.5 |
| 3,573,225 | 3/1971 | Kondo | 252/392 |
| 3,647,694 | 3/1972 | Swanson et al. | 252/51.5 A |
| 3,657,129 | 4/1972 | Obermeier | 252/515 R |
| 3,676,344 | 7/1972 | Ruceski | 252/49.3 |
| 3,699,057 | 10/1972 | Halko et al. | 252/49.3 |
| 3,799,876 | 3/1974 | White et al. | 252/51.5 R |
| 3,857,791 | 12/1974 | Marcellis et al. | 252/51.5 |
| 3,894,958 | 7/1975 | McCoy et al. | 252/51.5 A |
| 3,933,659 | 1/1976 | Lyle et al. | 252/51.5 A |
| 3,933,663 | 1/1976 | Thompson et al. | 508/555 |
| 3,994,815 | 11/1976 | Coleman | 252/52 |
| 4,007,121 | 2/1977 | Holder et al. | 252/51.5 A |
| 4,089,792 | 5/1978 | Lowe | 252/32.7 E |
| 4,102,796 | 7/1978 | Lowe | 252/47.5 |
| 4,151,101 | 4/1979 | Anzengerger et al. | 252/49.6 |
| 4,161,451 | 7/1979 | Lowe | 252/32.7 E |
| 4,208,293 | 6/1980 | Zaweski | 252/51.5 A |
| 4,280,915 | 7/1981 | Kercheville | 252/8.5 C |
| 4,280,916 | 7/1981 | Richards et al. | 252/33.4 |
| 4,293,432 | 10/1981 | Papay et al. | 252/49.9 |
| 4,342,658 | 8/1982 | Tincher et al. | 252/32.5 |
| 4,344,861 | 8/1982 | Levy | 252/50 |
| 4,388,201 | 6/1983 | Brownawell et al. | 252/49.6 |
| 4,390,439 | 6/1983 | Schwartz et al. | 252/73 |
| 4,391,722 | 7/1983 | Schwartz et al. | 252/73 |
| 4,430,234 | 2/1984 | Hasegawa et al. | 252/49.5 |
| 4,439,336 | 3/1984 | Zaweski | 252/32.7 E |
| 4,478,604 | 10/1984 | Schuettenberg | 44/63 |
| 4,491,526 | 1/1985 | Deck | 252/32.5 |
| 4,493,780 | 1/1985 | Schwartz et al. | 252/73 |
| 4,511,482 | 4/1985 | Murodysky | 252/51.5 A |
| 4,557,846 | 12/1985 | Wisotsky | 252/51.5 A |
| 4,640,787 | 2/1987 | Schuettenberg | 252/51.5 A |
| 4,743,389 | 5/1988 | Braid et al. | 252/51.5 A |
| 4,762,628 | 8/1988 | Phillips et al. | 252/51.5 R |
| 4,789,493 | 12/1988 | Horodysky | 508/554 |
| 4,816,171 | 3/1989 | Horodysky | 508/554 |
| 4,828,735 | 5/1989 | Minagawa et al. | 252/49.3 |
| 4,943,381 | 7/1990 | Phillips et al. | 252/51.5 R |
| 5,073,278 | 12/1991 | Schumacher et al. | 252/51.5 R |

FOREIGN PATENT DOCUMENTS

| | | |
|---|---|---|
| 120665 | 10/1984 | European Pat. Off. . |
| 356677 | 7/1990 | European Pat. Off. . |
| 809001 | 2/1955 | United Kingdom . |

*Primary Examiner*—Ellen M. McAvoy
*Attorney, Agent, or Firm*—Beverly A. Pawlikowski; David M. Shold; Joseph P. Fischer

[57] ABSTRACT

The present invention includes a composition which comprises a major amount of an oil of lubricating viscosity and a minor amount effective to inhibit metal corrosion of a soluble additive mixture comprising (A) at least one amide compound of a mono- or polycarboxylic acid or reactive derivative thereof; and (B) at least about 0.1 mole of at least one amine per mole of amide, provided that when (A) is an amide of a dicarboxylic acid and the amine is an alkanol amine, the mixture contains more than 0.5 equivalent of the amine (B) per equivalent of amide (A).

The compositions of the invention exhibit improved corrosion-inhibiting properties and the compositions are useful in a variety of lubrication applications. In particular the compositions are useful as hydraulic fluids.

49 Claims, No Drawings

OIL COMPOSITIONS USEFUL IN HYDRAULIC FLUIDS

This is a continuation of application Ser. No. 08/494,113 filed on Jun. 23, 1995, now abandoned, and Ser. No. 07/760,667 filed on Sep. 16, 1991 now abandoned.

FIELD OF THE INVENTION

This invention relates to oil compositions, and more particularly, to oil compositions useful in hydraulic fluids. More particularly, the invention relates to hydraulic fluids containing additives which inhibit metal corrosion:

BACKGROUND OF THE INVENTION

It is generally accepted that hydraulic fluids can be defined as any liquids which are necessary for the proper functioning of a hydraulic system. The primary function of the fluid is to transmit force which is applied at one point in the system to some other location in the system, and to quickly produce desired changes in the direction or the magnitude of that force. Hydraulic systems using these fluids are very common and have numerous applications in industry and daily life, including uses in automotive systems such as brakes, clutches, and transmissions, in industrial equipment for applications such as pressing, molding, mining, metal forming and positioning, in devices such as elevators, and in the transportation industry for many control and motive systems in ships and aircraft.

For optimal functioning, a hydraulic fluid must be relatively incompressible and must flow readily. In addition, there are a number of secondary functions provided by hydraulic fluids, which functions are extremely important for successful system operation, including adequate lubricity for moving parts, stability under anticipated conditions of use, compatibility with materials used to construct the hydraulic system, and the fluids should have the ability to protect system components against chemical reaction with materials which may enter the system.

Additives to the fluid which protect system components against chemical reaction are frequently called "corrosion inhibitors". Corrosion can result from the formation of reactive decomposition products of the fluid itself, from components of the fluid (e.g., additives) which are corrosive, or from the entry of contaminants into the hydraulic system. Corrosion is normally experienced with metal components of the system. A particularly common form of corrosion is the rusting of ferrous metals due to contact with moist air. Among the materials which are frequently used as corrosion inhibitors are salts of petroleum sulfonic acids, esters of naphthenic acids, metal soaps of various organic acids, metal salts of alkyl thiophosphoric acids, amine succinates and alkaline earth metal sulfonates. Many corrosion inhibitors act by forming a protective film on a metal surface, thus preventing corrosive chemicals from contacting that surface. Other corrosion inhibitors act as "metal deactivators," which form chelate-type compounds with metals.

U.S. Pat. No. 2,403,067 discloses oil-soluble corrosion inhibitors, which are prepared by reacting an unsaturated fatty acid with an alkanolamine in a molar ratio of about 1:1 to form an amide. An appreciable proportion of ester is also apparently formed during the reaction.

U.S. Pat. Nos. 2,892,854 and 2,967,831 describe corrosion inhibited aqueous hydraulic fluids containing the reaction product of fatty acids and a stoichiometric excess of an alkanolamine. The ratio of NH groups of the amine to COOH groups of the acid is between 1.1:1 and 1.5:1, and the reaction is continued only until 75 to 90% of the acid has been reacted.

U.S. Pat. No. 4,151,101 discloses foam control in non-aqueous fluid systems, including adding an organo-silicone compound in combination with the reaction product of an alkanolamine and a fatty acid.

U.S. Pat. No. 4,208,293 describes lubricating oils which contain a minor, friction reducing amount of the reaction product of 1 to 3 moles of fatty acids, such as oleic acid, and 1 mole of diethanolamine.

U.S. Pat. No. 4,293,432 discloses lubricating oil compositions which contain a friction reducing additive prepared by reacting fatty acids containing 12 to 22 carbon atoms with monoethanolamine. An excess of the amine can be used in the reaction, but any unreacted monoethanolamine is removed.

U.S. Pat. No. 4,557,846 describes lubricating compositions reported to have improved friction reducing properties. The compositions contain a hydroxy amide compound of a dimer carboxylic acid obtained by reacting one or more moles of hydroxyamine with one mole of dimer acid. More particularly, from about 1:1 to 3:1 moles of hydroxyamine per mole of dimer acid is used with about 1:1 to 2:1 being preferred.

SUMMARY OF THE INVENTION

The present invention includes a composition which comprises at least about 70% by weight of an oil of lubricating viscosity and a minor amount effective to inhibit metal corrosion of a soluble additive mixture comprising (A) at least one amide compound of a mono- or polycarboxylic acid or reactive derivative thereof; and (B) at least about 0.1 mole of at least one amine per mole of amide, provided that when (A) is an amide of a dicarboxylic acid and the amine is an alkanolamine, the mixture contains more than 0.5 equivalent of the amine (B) per equivalent of amide (A).

The compositions of the invention comprising the amide/amine mixtures exhibit improved corrosion-inhibiting properties, and the compositions are useful in a variety of lubrication applications. In particular the compositions are useful as hydraulic fluids.

DETAILED DESCRIPTION OF THE INVENTION

Unless otherwise specified in the disclosure and claims, the following definitions are applicable. The term "hydrocarbyl" denotes a group or substituent having a carbon atom directly attached to the remainder to the molecule and having predominantly hydrocarbon character.

Examples of hydrocarbyl groups or substituents which can be useful in connection with the present invention include the following:

(1) hydrocarbon groups or substituents, that is aliphatic (e.g., alkyl or alkenyl), alicyclic (e.g., cycloalkyl, or cycloalkenyl) substituents, aromatic, aliphatic and alicyclic-substituted aromatic nuclei and the like, as well as cyclic substituents wherein the ring is completed through another portion of the molecule (that is, for example, any two indicated substituents may together form an alicyclic group);

(2) substituted hydrocarbon groups or substituents, that is, those containing nonhydrocarbon substituents which, in the context of this invention, do not alter the predominantly hydrocarbon character of the substituted group or substituent and which do not interfere with the reaction of a component or do not adversely affect the performance of a material when it is used in an application within the context of this invention; those skilled in the art will be aware of such groups (e.g., alkoxy, carbalkoxy, alkylthio, sulfoxy, etc.);

(3) hetero groups or substituents, that is, groups or substituents which will, while having predominantly hydrocarbon character, contain atoms other than carbon present in a ring or chain otherwise composed of carbon atoms. Suitable heteroatoms will be apparent to those of ordinary skill in the art and include, for example, sulfur, oxygen, and nitrogen. Moieties such as pyridyl, furanyl, thiophenyl, imidazolyl, and the like, are exemplary of hetero groups or substituents. Up to two heteroatoms, and preferably no more than one, can be present for each 10 carbon atoms in the hydrocarbon-based groups or substituents.

Typically, the hydrocarbon-based groups or substituents of this invention are essentially free of atoms other than carbon and hydrogen and are, therefore, purely hydrocarbon.

The terms hydroxyhydrocarbyl group and hydroxyalkyl group as used in this specification and claims refer to hydroxy-substituted hydrocarbyl groups and hydroxy-substituted alkyl groups respectively. The terms aminohydrocarbyl group and aminoalkyl group refer to amino-substituted hydrocarbyl groups and amino-substituted alkyl groups respectively.

The number of equivalents of the carboxylic acids and amides depends upon the total number of carboxylic functions present (acid or amide). In determining the number of equivalents of an acid (or reactive derivative thereof), those carboxyl functions which are not capable of reacting as a carboxylic acid are excluded. In general, however, there is one equivalent of acylating agent for each carboxy group (or derivative thereof). For example, a monocarboxylic acid contains one equivalent per mole. There are two equivalents in a dicarboxylic acid or anhydride, and three equivalents in a tricarboxylic acid.

An equivalent weight of an amine or a polyamine is the molecular weight of the amine or polyamine divided by the total number of nitrogen atoms present in the molecule. Thus, ethyl amine has an equivalent weight equal to its molecular weight; ethylene diamine has an equivalent weight equal to one-half of its molecular weight; diethylene triamine has an equivalent weight equal to one-third of its molecular weight. The equivalent weight of a commercially available mixture of polyalkylene polyamines can be determined by dividing the atomic weight of nitrogen (14) by the percent nitrogen contained in the polyamine and multiplying by 100. Thus, a polyamine mixture containing 34% nitrogen would have an equivalent weight of 41.2.

For the purposes of this invention, an equivalent weight of a hydroxy-substituted amine is its molecular weight divided by the total number of nitrogen atoms present in the molecule. Thus, for the purposes of this invention, the hydroxyl groups are ignored when calculating equivalent weight. For example, ethanolamine has an equivalent weight equal to its molecular weight, and diethanolamine has an equivalent weight (nitrogen-based) equal to its molecular weight.

Hydraulic fluids can be categorized in two general classes: nonaqueous fluids and aqueous fluids. Aqueous-containing fluids can have a significant nonaqueous content, as in high-water-based fluids, water-in-oil emulsions or oil-in-water emulsions. However, hydraulic fluids containing the compositions of this invention will be considered as including only nonaqueous fluids, in which any aqueous material will be present only in very small quantities as a contaminant (e.g., <0.5%). The nonaqueous hydraulic fluids are primarily oils of lubricating viscosity containing property modifying additives as may be required for particular end uses.

The compositions of this invention employ an oil of lubricating viscosity, including natural or synthetic lubricating oils or mixtures thereof, in a major amount. Natural oils include animal oils and vegetable oils (e.g.. castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins, etc., and mixtures thereof, alkylbenzenes, polyphenyls (e.g., biphenyls, terphenyls, alkylated polyphenyls, etc.) alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of synthetic lubricating oils which can be used.

Another suitable class of synthetic lubricating oils comprises the esters of dicarboxylic acids with a variety of mono- and polyhydric alcohols or polyol ethers, and those made from $C_5$ to $C_{12}$ monocarboxylic acids and polyols and polyol ethers.

Other useful synthetic lubricating oils include liquid esters of phosphorus-containing acids, polymeric tetrahydrofurans and the like, silicon-based oils such as the polyalkyl-, polyaryl-, polyalkoxy-, or polyaryloxy-siloxane oils and silicate oils.

Unrefined, refined and rerefined oils, either natural or synthetic (as well as mixtures of two or more of any of these) of the type disclosed hereinabove can be used in the hydraulic fluids of the present invention. Unrefined oils are those obtained directly from a natural or synthetic source without further purification treatment. Refined oils are similar to the unrefined oils except they have been treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given by Chamberlin III, U.S. Pat. No. 4,326,972 which is hereby incorporated by reference.

A basic, brief description of lubricant base oils appears in an article by D. V. Brock in *Lubrication Engineering*, Volume 43, pages 184–5, March 1987, which article is incorporated by reference.

The corrosion inhibiting soluble additive mixture of this invention comprises at least one amide compound of a mono- or polycarboxylic acid or derivative thereof, and at least 0.1 equivalent of at least one amine per equivalent of amide provided that when the amide is an amide of a dicarboxylic acid, the additive mixture contains more than 0.5 equivalent of amine per equivalent of amide.

(A) Amide

The amides which are utilized in the compositions of the present invention may be amides of mono- or polycarboxylic acids or reactive derivatives thereof. In one embodiment, the amides may be characterized by one or more of the following formulae $$R[C(O)NR^1R^2]_n \quad (I)$$

-continued

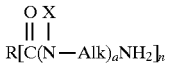

(II)

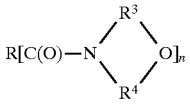

(III)

wherein R is a hydrocarbyl group containing from about 6 to about 90 carbon atoms; each of $R^1$, $R^2$, and X is independently hydrogen or a hydrocarbyl, aminohydrocarbyl, hydroxyhydrocarbyl or a heterocyclic-substituted hydrocarbyl group, provided that both $R^1$ and $R^2$ are not hydrogen; each of $R^3$ and $R^4$ is, independently, a hydrocarbylene group containing up to about 10 carbon atoms; Alk is an alkylene group containing up to about 10 carbon atoms; a is an integer of from 2 to about 10, and n is 1, 2 or 3.

When n is 1, i.e., the amide is derived from a monocarboxylic acid, R generally is a hydrocarbyl group containing from 6 to about 30 or 38 carbon atoms and more often will be a hydrocarbyl group derived from a fatty acid containing from 12 to about 24 carbon atoms.

When n is 2 or 3, that is, when the amide is derived from a di- or tricarboxylic acid, R will contain from 6 to about 90 carbon atoms depending on the type of polycarboxylic acid. For example, when the amide is derived from a dimer acid, R generally will contain from about 18 to about 44 carbon atoms or more, and amides derived from trimer acids generally will contain an average of from about 44 to about 90 carbon atoms.

Each of $R^1$, $R^2$ and X in Formulae I and II is independently hydrogen or a hydrocarbyl, aminohydrocarbyl, hydroxyhydrocarbyl or a heterocyclic-substituted hydrocarbon group containing up to about 10 carbon atoms. In one embodiment, $R^1$, $R^2$ and X may be independently heterocyclic substituted hydrocarbyl groups wherein the heterocyclic substituent is derived from pyrrole, pyrroline, pyrrolidine, morpholine, piperazine, piperidine, pyridine, pipecoline, etc.

In one embodiment, at least one of $R^1$ and $R^2$ of Formula I is a hydroxyhydrocarbyl or an aminohydrocarbyl group, and in another embodiment, none of $R^1$ and $R^2$ is hydrogen. In one preferred embodiment, $R^1$ and $R^2$ are both hydroxyhydrocarbyl groups.

Specific examples of $R^1$, $R^2$ and X groups include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The Alk group in Formula II is an alkylene group containing from 1 to about 10 carbon atoms. Examples of such alkylene groups include, methylene, ethylene, propylene, etc.

$R^3$ and $R^4$ in Formula III also are hydrocarbylene groups, and in particular, alkylene group containing up to about 10 carbon atoms. Examples of such hydrocarbylene groups include, methylene, ethylene, propylene, etc.

The amide represented by Formula III contains at least one morpholinyl group. In one embodiment, the morpholine structure is formed as a result of the condensation of two hydroxy groups which are attached to the hydrocarbylene groups $R^3$ and $R^4$.

Typically, the amides of Formula I are prepared by reacting a carboxylic acid or reactive derivative thereof with an amine which contains at least one >NH group which may be represented by the formula $$R^1R^2NH$$

wherein $R^1$ and $R^2$ are as defined above. Amides of the type represented by Formula II are prepared by reaction of the carboxylic acid or reactive derivative thereof with a polyamine, and as noted above, amides of the type represented by Formula III can be prepared by the reaction of a carboxylic acid or reactive derivative thereof with a dihydroxy alkyl amine followed by the removal of water and ring closure. The various reactions which can be utilized to form amides of the type utilized in the present invention are well known in the art and are summarized in, for example, W. H. Reusch, *An Introduction to Organic Chemistry*, Holden-Day, Inc., San Francisco, 1977, at pages 446–454. The preparation of the amides and the amide/amine additive mixtures of the present invention is described more fully below.

Some examples of amides which may included in the amide/amine additive mixture used in the present invention include decanoic ethanolamide, lauric ethanolamide, coconut diethanolamide, lauric diethanolamide, oleic ethanolamide, oleic diethanolamide, lauric di-(1-propanol) amide, etc.

(B) Amine

The amines which are present in the compositions of the present invention may be characterized by at least one of the formulae $$R^5R^6NH \quad \text{(IV)}$$

$$H(N(X)\text{-Alk-})_aNH_2 \quad \text{(V)}$$

wherein $R^5$, $R^6$ and X are each independently hydrogen or hydrocarbyl, aminohydrocarbyl or hydroxyhydrocarbyl groups containing up to about 10 carbon atoms provided that both $R^5$ and $R^6$ are not hydrogen; Alk is an alkylene group containing up to about 10 carbon atoms; and a is 2 to about 10.

$R^5$, $R^6$ and X of Formulae IV and V may be any of the groups described above with respect to $R^1$, $R^2$ and X of Formulae I and II. In one embodiment, $R^1$ and $R^2$ of Formula I are the same as $R^5$ and $R^6$ of Formula IV, and X and Alk of Formula II are the same as X and Alk of Formula V. Thus, all of the examples of groups represented by $R^1$, $R^2$ and X given above are also examples of $R^5$ and $R^6$ groups in Formula IV and X groups in Formula V.

The amines represented by Formula IV may be primary amines or secondary amines containing one or two hydrogen atoms attached to the nitrogen. In one preferred embodiment, the amine of Formula IV is a secondary amine wherein $R^5$ and $R^6$ are each independently amino hydrocarbyl or hydroxy hydrocarbyl groups containing up to about 10 carbon atoms. The amines useful in the compositions of the present invention may be individual amines or mixtures of amines. Many of the mixtures are commercially available and desirable because of their low cost and oil-solubility. As apparent from Formulae IV and V, the amines useful in the present Invention include monoamines and polyamines which contain at least one >NH or $-NH_2$ group. The amines may be aliphatic, cycloaliphatic, aromatic or heterocyclic including aliphatic-substitutedcycloaliphatic, aliphatic-substitutedaromatic, heterocyclic-substituted aliphatic, heterocyclic-substituted alicyclic and heterocyclic-substituted aromatic amines, and the amines may be saturated or unsaturated although the saturated amines are presently preferred. The amines also may contain non-hydrocarbon substituents of groups as long as these groups do not significantly effect the hydrocarbon character of the hydrocarbyl groups.

Aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, etc. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methyl pyrrole, 2-(2-aminoethyl)-1-methylpyrrolidine and 4-(2-aminoethyl) morpholine, 1-(2-aminoethyl)piperazine, 1-(2-aminoethyl) piperidine, 2-(2-aminoethyl)pyridine, 1-(2-aminoethyl) pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexyl-amines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl) amine, naphthylamine, N-(n-butyl)-aniline, and the like. Examples of aliphatic-substituted, cycloaliphatic-substituted, and heterocyclic-substituted aromatic monoamines are para-ethoxy-aniline, para-dodecylaniline, cyclohexyl-substituted naphthylamine, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including those conforming to the formula $$H(N(X)\text{-}Alk)_aNH_2 \quad (V)$$

wherein X is hydrogen, or a hydrocarbyl, amino hydrocarbyl, hydroxyhydrocarbyl or heterocyclic-substituted hydrocarbyl group containing up to about 10 carbon atoms, Alk is an alkylene group containing up to about 10 carbon atoms, and a is 2 to about 10. Preferably, Alk is ethylene or propylene. Usually, a will have an average value of from 2 to about 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in *The Encyclopedia of Chemical Technology*, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° SC. of 1121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Hydroxyalkyl alkylene polyamines having one or more hydroxyalkyl substituents on the nitrogen atoms, are also useful. Preferred hydroxyalkyl-substituted alkylene polyamines are those in which the hydroxyalkyl group is a lower hydroxyalkyl group, i.e., having less than 8 carbon atoms. Examples of such hydroxyalkyl-substituted polyamines include N-(2-hydroxyethyl)ethylene diamine, N,N-bis(2-hydroxyethyl) ethylenediamine, 1-(2-hydroxyethyl)piperazine, monohydroxypropyl-substituted diethylene tetraamine, dihydroxypropyl-substituted tetraethylene pentamine, N-(2-hydroxybutyl)tetramethylene diamine, etc. Higher homologs as are obtained by condensation of the above-illustrated hydroxy alkylene polyamines through amino groups or through hydroxy groups are likewise useful as (a). Condensation through amino groups results in a higher amine accompanied by removal of ammonia and condensation through the hydroxy groups results in products containing ether linkages accompanied by removal of water.

The amide/amine additive mixtures useful in preparing the compositions of the present invention may be prepared by simply mixing the desired amide or mixture of amides (A) with the desired amine or mixtures of amines (B) described above. The mixture comprises at least 0.1 mole of the amine per mole of amide.

In one embodiment, the amine is present in the mixture in amounts of at least 0.5 mole per mole of amide, and in one preferred embodiment, the amine is present in an amount greater than 0.5 equivalent of amine per equivalent of amide. The upper limit of the amine present in the mixture and in the composition of the invention is not critical so long as the amount of amine does not exceed the solubility of the amine in the oil-containing compositions of the present invention or have an adverse effect on the compositions of the invention. Generally, the upper limit of the amine present will not exceed 10 moles per mole of amide and more often will not exceed 5.0 moles or even 2.5 moles per mole of amide.

In another embodiment of the present invention, the additive mixture can be prepared by reacting a carboxylic acid or reactive derivative thereof such as an ester, amide, acid halide, anhydride or ketene thereof with at least 1.1 n moles of an amine per mole of carboxylic acid $R[COOH]_n$ or reactive derivative thereof where n is equal to the number of carboxy groups in the carboxylic acid. It is generally desired to react the carboxylic acid or reactive derivative thereof with the amine until more than 90% or even 95% of the total equivalents of carboxylic acid (or derivative) are reacted with the amine. In one preferred embodiment, essentially all of the carboxylic acid or reactive derivative thereof is reacted thus producing a product which contains essentially no free acid, i.e., less than 2% free acid.

The reaction between the carboxylic acids or reactive derivatives thereof and the amine containing at least one >NH group typically is conducted under an inert atmosphere at temperatures of about 160° C. to about 190° C. until the reaction is complete. Reaction times of up to about 12 hours may be required for the reaction. A trap is normally provided for removing low boiling reaction products such as water, alcohols, esters, etc. Procedures for reacting carboxylic acids or reactive derivatives thereof with amines are well known to those skilled in the art.

The carboxylic acids which can be utilized to prepare the amides and the additive mixtures of the present invention may be mono- or polycarboxylic acids of the formula $$R[COOH]_n$$

or reactive derivative thereof wherein R is a hydrocarbyl group containing from 6 to about 90 carbon atoms and n is 1, 2 or 3.

Monocarboxylic acids (n=1) include fatty acids and Alder (Ene reaction) monocarboxylic reaction products. Fatty acids generally contain from about 8, preferably from about 10, more preferably from about 12 to about 30, more preferably to about 24 carbon atoms. Examples of fatty acids include stearic, oleic, lauric, linoleic, abietic, palmitic, sebacic, linolenic, behenic, tall oil and rosin acids. Mixtures of fatty acids, including commercial mixtures may be used. For example, Industrene 325 and 328 are mixtures of $C_{12}$ to $C_{18}$ fatty acids (coconut) with about 70% saturated $C_{12}$ which are available from Humko Chemical Division of the Witco Corporation.

The monocarboxylic acids may also be the reaction product of an α,β-unsaturated carboxylic acid (e.g., acrylic or methacrylic acid) with one or more olefins. This reaction is known as the "Ene" reaction or the Alder reaction. The olefins are preferably alpha-olefins (sometimes referred to as mono-1-olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. The $C_{16}$ and $C_{16-18}$ alpha-olefins are particularly preferred.

Isomerized alpha-olefins may also be used. These olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly these procedures involve contacting alpha-olefin with a cation exchange resin at a temperature in a range of about 80° to about 130° C. until the desired degree of isomerization is achieved. These procedures are described for example in U.S. Pat. No. 4,108,889 which is incorporated herein by reference.

The polycarboxylic acids (n=2 or 3) used in the present invention include dicarboxylic acids such as succinic acids, dimer acids, Alder diacids, and Diels-Alder dicarboxylic acids. Tricarboxylic acids include trimer acids, Alder triacids, and Diels-Alder tricarboxylic acids.

The dimer acids include products resulting from the dimerization of unsaturated fatty acids, e.g., the above-described fatty acids. Generally, the dimer acids have an average from about 18, preferably from about 28 to about 44, preferably to about 40 carbon atoms. In one embodiment, the dimer acids have preferably about 36 carbon atoms. The dimer acids are preferably prepared from $C_{18}$ fatty acids, such as oleic acids. The dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of dimer acids include Empol® 1014, 1016 and 1018 Dimer Acid, each available from Emery Industries, Inc. and Hystrene® dimer acids 3675, 3680, 3687 and 3695, available from Humko Chemical.

In another embodiment, the polycarboxylic acids are dicarboxylic acids which are the reaction products of an unsaturated fatty acid (e.g., the above-described fatty acids, preferably tall oil acids and oleic acids) with an alpha,beta-ethylenically unsaturated carboxylic acid (e.g., acrylic or methacrylic acid) such as are taught in U.S. Pat. No. 2,444,328, the disclosure of which is incorporated herein by reference. Examples of these dicarboxylic acids include Westvacos® Diacid H-240, 1525 and 1550, each being commercially available from the Westvaco Corporation.

In another embodiment the polycarboxylic acids or anhydrides are hydrocarbyl-substituted succinic acids or anhydrides. The hydrocarbyl group generally contains an average from about eight, preferably from about 14, more preferably from about 16 to about 40, preferably to about 30, more preferably to about 24, still more preferably to about 18 carbon atoms. Preferably, the hydrocarbyl group is an alkenyl group. The alkenyl group may be derived from one or more of the above-described olefins.

The succinic acids are prepared by reacting the above-described olefins or isomerized olefins with unsaturated carboxylic acids such as fumaric acids or maleic acid or anhydride at a temperature of about 160° to about 240° C., preferably about 185° C. to about 210° C. Free radical Initiators (e.g., t-butyl catechol) may be used to reduce or prevent the formation of polymeric byproducts. The procedures for preparing the carboxylic acids are well known to those skilled in the art and have been described for example in U.S. Pat. No. 3,412,111; and Ben et al, "The Ene Reaction of Maleic Anhydride With Alkenes", J. C. S. Perkin II (1977), pages 535–537. These references are incorporated by reference for their disclosure of procedures for making the above carboxylic acids.

The polycarboxylic acids may also be tricarboxylic acids. Examples of tricarboxylic acids include trimer and Diels-Alder tricarboxylic acids. These acids generally contain an average from about 18, preferably from about 30, more preferably from about 36 to about 90, preferably 66, more preferably to about 60 carbon atoms. Trimer acids are prepared by the trimerization of the above-described fatty acids. The Diels-Alder tricarboxylic acids are prepared by reacting an unsaturated monocarboxylic acid with a alpha, beta-ethylenically unsaturated dicarboxylic acid (e.g., fumaric acid or maleic acid or anhydride). In one embodiment, the Diels-Alder tricarboxylic acid contains an average from about 12, preferably from about 18 to about 40, preferably to about 30 carbon atoms. Examples of these tricarboxylic acids include Empol® 1040 available commercially from Emery Industries, Hystrene® 5460 available commercially from Humko Chemical, and Unidyme® 60 available commercially from Union Camp Corporation.

In addition to the above-described carboxylic acids, the amides and the additive mixtures of the present invention may be prepared by reacting an amine containing at least one >NH group with a reactive derivative of the above-described carboxylic acids which is capable of reacting with the amine to form an amide. Accordingly, unless otherwise indicated, the discussion with respect to the carboxylic acids and to the reactions of carboxylic acids with amines is intended to include reactive derivatives of the carboxylic acids such as anhydrides, esters, amides, acid halides, ketenes, lactones, etc., which are capable of reacting with an amine containing at least one >NH group to form amides. Acids or anhydrides are preferred reactants. Low molecular weight esters and amides obtained by reacting a carboxylic acid or anhydride with a low molecular weight alcohol or amine containing, for example, from 1 to 7 carbon atoms and more often from 1 to about 4 carbon atoms also can be utilized since the low molecular weight alcohol or amine can be displaced by the higher molecular weight amines with the formation of a volatile alcohol or amine which can be removed from the reaction mixture. Examples of such reactive derivatives include methyl oleate, methyl stearate, ethyl oleate, propyl oleate, N-methyl oleamide, N-ethyl oleamide, N-methyl stearamide, etc.

Examples of carboxylic acid halides which can be reacted with the amines described above include various halogen compounds, and in particular, the chloride derivatives such as, for example, stearoyl chloride, oleoyl chloride, etc. When the reactive derivative is an acid halide, a larger excess of amine is required since two equivalents of amine react with one equivalent of the acid halide forming one equivalent of the desired amide and one equivalent of the amine halide salt.

Ketenes are formed from carboxylic acids by elimination of water in accordance with the following general reaction.

$$RCH_2COOH \rightarrow RCH_2{=}C{=}O + H_2O$$

The ketene can be reacted with an amine to form an amide in accordance with the following reaction.

$$RCH_2{=}C{=}O + R'NH_2 \rightarrow RCH_2CONHR'$$

The amines which are reacted with the carboxylic acid or reactive derivative thereof to form the amides and additive mixtures of the present invention may be characterized by at least one of the formulae $$R^5R^6NH \quad \text{(IV)}$$

$$H(N(X)\text{-}Alk\text{-})_aNH_2 \quad \text{(V)}$$

wherein $R^5$, $R^6$ and X are each independently hydrogen or hydrocarbyl, aminohydrocarbyl or hydroxyhydrocarbyl groups containing up to about 10 carbon atoms provided that both $R^5$ and $R^6$ are not hydrogen; Alk is an alkylene group containing up to about 10 carbon atoms; and a is 2 to about 10.

Any of the amines or polyamines described above is being present in the additive mixtures of the present invention and identified as component (B) can be utilized in the reaction. Accordingly, the $R^5$ and $R^6$ groups in Formula IV may be the same as the $R^1$ and $R^2$ groups in the amide of Formula I.

The following examples illustrate the preparation of the additive mixtures (amide/amine) by reaction of a carboxylic acid or reactive derivative with an excess of amine. Unless otherwise indicated in the following examples and elsewhere in the specification and claims, all parts and percentages are by weight, temperatures are in degrees Centigrade, and pressure is at or near atmospheric pressure.

EXAMPLE 1

A two-liter flask, fitted with a Dean-Stark trap and heating means is charged with 480 parts (2.29 moles) of commercially available coconut oil fatty acids (Industrene 328) and 481 parts (4.58 moles) of diethanolamine. The contents of the flask are heated under an atmosphere of nitrogen to 160°–165° C. and maintained at this temperature for 12 hours. During this period, about 62 parts of water is collected in the trap. The residue is filtered through a filter aid at 130°–140° C., and the filtrate is the desired product containing 7.2% nitrogen (theory, 7.13).

EXAMPLE 2

Following the general procedure of Example 1, a mixture of 414 parts (2 moles) of coconut oil fatty acids available commercially under the designation (Industrene 325), and 224 parts (4 moles) of ethanolamine is prepared and heated under nitrogen at 160°–170° C. for about 12 hours while removing water. The residue is filtered through filter aid at 130° C., and the filtrate is the desired product containing 8.32% nitrogen (theory, 9.12).

EXAMPLE 3

A mixture of 270 parts (1.3 equivalents) of Industrene 325 and 112 parts (2.6 equivalents) of a polyethyleneamine distillation bottoms fraction is heated under nitrogen at 160°–165° C. for 12 hours while removing water as a distillate. The residue is collected as the desired product which contains 10.56% nitrogen (theory, 10.05).

EXAMPLE 4

A mixture of 300 parts (1.43 equivalents) of Industrene 328 and 226 parts (2.15 equivalents) of diethanolamine is prepared and heated at 160°–165° C. under nitrogen for 14 hours while removing water as a distillate. The residue is filtered with a filter aid at 120°–130° C., and the filtrate is the desired product containing 6.12% nitrogen (theory, 6.18).

EXAMPLE 5

A mixture of 212 parts (0.715 mole) of methyl oleate and 113 parts (1.07 moles) of diethanolamine Is prepared and heated at 170°–180° C. under nitrogen for 12 hours while removing methanol as a distillate. The residue is filtered with a filter aid at 140°–150° C., and the filtrate is the desired product containing 5.11% nitrogen (theory, 5.08).

EXAMPLE 6

A mixture of 500 parts (1.69 moles) of methyl oleate and 354 parts (3.37 moles) of diethanolamine is heated under nitrogen at 180°–190° C. for 12 hours while removing methanol as a distillate. The residue is cooled to 110° C. and filtered over a filter aid. The filtrate is the desired product containing 5.88% nitrogen (theory, 5.90). The product also is characterized as having an acid number to a phenolphthalein end point of 7.9.

EXAMPLE 7

A mixture of 400 parts (1.35 moles) of methyl oleate and 165 parts (2.70 moles) of ethanolamine is heated under nitrogen at 155°–160° C. for 12 hours while collecting methanol as a distillate. The residue is filtered over a filter aid at 130°–140° C., and the filtrate is the desired product containing 6.68% nitrogen (theory, 7.34).

EXAMPLE 8

A mixture of 240 parts (0.85 mole) of commercially available oleic acid and 104 parts (1.7moles) of ethanolamine are heated at 160°–170° C. for about 12 hours while removing water as a distillate. The residue is filtered through a filter aid, and the filtrate is the desired product containing 6.89% nitrogen (theory, 7.39).

EXAMPLE 9

The general procedure of Example 8 is followed using 350 parts (1.24 moles) of oleic acid and 195 parts (1.86 moles) of diethanolamine.

EXAMPLE 10

The general procedure of Example 8 is followed using 550 parts (1.96 moles) of oleic acid and 412 parts (3.92 moles) of diethanolamine. The product contains 5.53% nitrogen (theory, 5.93) and is characterized by an acid member to a phenolphthalein end point of 4.5.

Mixtures of amides and amines useful in the present invention are also available commercially. For example, Unamide™C-72-3 is available from Lonza Inc., Fairlawn, N. J., and is reported to be the reaction product of 2 moles of diethanolamine with 1 mole of coconut oil fatty acid.

When the additive mixtures of the present invention comprising an amide and an amine are prepared by reaction of a carboxylic acid with an excess of a hydroxyamine, the mixture or reaction product obtained generally may contain, in addition to the desired amide and unreacted amine, a small amount (for example, up to about 20% by weight) of an ester. The ester may be performed as the result of the condensation of the hydroxy group of the hydroxyamine with the carboxyl function with the loss of water, or the ester may be formed by a rearrangement of the initially formed amide containing a pendant hydroxy alkyl group. The presence of such esters does not appear to have any adverse affect on the usefulness of the additive mixtures of the present invention.

The compositions of the present invention comprise at least about 70% by weight of an oil of lubricating viscosity and an amount of the additive mixtures of the present invention which have been described above which is effective to provide the composition with the desired metal corrosion inhibiting properties. Generally, the compositions of the present invention will contain, in addition to the oil of lubricating viscosity, from about 0.01 to about 5% by weight of the soluble additive mixture. More often, the compositions will contain at least about 90% by weight of oil and from about 0.01 to about 0.5% by weight of the additive mixture.

The compositions of the present invention are useful in a variety of applications, and particularly those applications wherein lubricity, thermal stability and corrosion resistance are desired. The compositions of the invention are useful in crankcase lubricating oils for spark-ignited and compression-ignited internal combustion engines including automobile and truck engines, two-cycle engines, etc. Transaxle lubricants, gear lubricants, and other lubricating oil and grease compositions, as well as functional fluids such as hydraulic fluids and automatic transmission fluids can be prepared with the compositions of the present invention. The compositions of the present invention are useful particularly as hydraulic fluids.

In addition to the oil of lubricating viscosity and the amide/amine additive mixture, the compositions of the present invention may, and generally do contain, other additives to provide additional desirable properties depending upon the nature of the base fluid and the intended use of the lubricant. The following are among the numerous types of additives which are known in the art: antiwear agents, oxidation inhibitors, metal deactivating compounds, detergents, dispersants, foam-inhibitors, thermal stabilizers, etc.

Extreme pressure agents and corrosion- and oxidation-inhibiting agents which may be included In the compositions of the invention are exemplified by chlorinated aliphatic hydrocarbons such as chlorinated wax; organic sulfides and polysulfides such as benzyl disulfide, bis(chlorobenzyl) disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite,, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl) (phosphorodithioate, cadmium dinonylphosphorodithioate, and the reaction of phosphorus pentasulfide with an equimolar mixture of isopropyl alcohol and n-hexyl alcohol.

Many of the above-mentioned extreme pressure agents and corrosion-oxidation inhibitors also serve as anti-wear agents. Esters and salts, particularly metal salts of dialkylphosphorodithioates are well known examples.

Examples of esters of the dialkylphosphorodithioic acids include esters obtained by reaction of the dialkyl phosphorodithioic acid with an α,β-unsaturated carboxylic acid (e.g., methyl acrylate) and, optionally an alkylene oxide such as propylene oxide.

In an especially useful embodiment, the hydraulic fluid compositions of the present invention contain, as an anti-wear agent, at least one metal dihydrocarbyldithiophosphate characterized by the formula

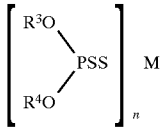

(VI)

wherein $R^3$ and $R^4$ are each independently hydrocarbyl groups containing from 3 to about 13 carbon atoms, M is a metal, and n is an integer equal to the 25 valence of M.

Generally, the compositions of the present invention will contain varying amounts of one or more of the above-identified metal dithiophosphates such as from about 0.01 to about 2% by weight, and more generally from about 0.01 to about 1% by weight, based on the weight of the total composition.

The hydrocarbyl groups $R^3$ and $R^4$ in the dithiophosphate of Formula VI may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50° C. to about 200° C. Thus, the preparation of O,O-di-n-hexyl phosphorodithioic acid involves the reaction of a mole of phosphorus pentasulfide with four moles of n-hexyl alcohol at about 100° C. for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^3$ and $R^4$ in Formula VI are derived from secondary alcohols such as isopropyl alcohol, secondary butyl alcohol, 2-pentanol, 2-methyl-4-pentanol, 2-hexanol, 3-hexanol, etc.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-l-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

The oxidation inhibitors that are particularly useful in the hydraulic fluid compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably present in the hydraulic fluids of the invention at levels of about 0.05% to about 5%, more preferably about 0.25 to about 2% by weight based on the total weight of such compositions.

Metal deactivating compounds which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred.

Anti-foam agents are used to reduced or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

When additional additives are used in the compositions of the present invention in formulating hydraulic fluid compositions, the additional additives are used in concentrations in which they are normally employed in the art. Thus, they will generally be used in a concentration of from about 0.001% up to about 25% by weight of the total composition, depending, of course, upon the nature of the additive and the nature of the automatic transmission fluid composition.

The compositions of the present invention comprising oil and the additive mixture, and the optional components described above can be prepared by dissolving or suspending the various components directly into the oil of lubricating viscosity in amounts required to form the desired composition. More often, the chemical components of the present invention are diluted with a substantially inert, normally liquid organic diluent such as mineral oil to form an additive concentrate. These concentrates generally comprise from about 10 to about 90% by weight of a normally liquid, substantially inert inorganic diluent/solvent, from about 5 to about 95% by weight of the amide/amine additive mixture of the present invention, and, optionally, one or more of the other additives described above. More often, the concentrates will contain 15%, 20%, 30% or 50% or higher of the chemical additives, and the remainder is diluent/solvent.

For example, concentrates may contain from about 10 to about 50% by weight of the amide/amine additive mixture and from 50 to 90% by weight of diluent/solvent. Other concentrates may contain from about 10 to about 50% by weight of the amide/amine additive mixture and from 0.01 to about 15% by weight of a metal phosphorodithioate.

The following examples illustrate the concentrates and lubricant compositions of the present invention and concentrates useful in preparing such lubricants.

| | Parts/Wt. |
|---|---|
| Concentrate No. 1 | |
| Mineral oil | 90 |
| Product of Ex. 6 | 10 |
| Concentrate No. 2 | |
| Mineral oil | 85 |
| Product of Ex. 5 | 15 |
| Concentrate No. 3 | |
| Mineral oil | 88 |
| Product of Ex. 6 | 10 |
| Zinc phosphorodithioate from 2-ethylhexanol and phosphorus pentasulfide | 2 |
| Lubricant A | |
| 250 neutral petroleum oil | 99.95 |
| Product of Example 5 | 0.05 |
| Lubricant B | |
| 250 neutral petroleum oil | 99.5 |
| Product of Example 5 | 0.5 |
| Lubricant C | |
| 250 neutral petroleum oil | 99.95 |
| Product of Example 6 | 0.05 |

-continued

| | Parts/Wt. |
|---|---|
| Lubricant E | |
| Mineral oil | 99.90 |
| N,N-dihydroxylethyl oleamide | 0.07 |
| diethanolamine | 0.03 |
| Lubricant F | |
| 250 neutral petroleum oil | 99.95 |
| Unamide ™ C-72-3 | 0.05 |

Lubricants G-P

The lubricants (hydraulic fluids) of Examples G-P contain 0.05% of an alkylated diphenylamine antioxidant, 0.6% by weight of a dialkyldithiophosphoric acid ester antiwear agent, 0.007% of an ethylene oxide treated mixture of alkyl phenol and alkyl amine (Tolad 370) as a demulsifier, 0.005% of tolyl triazole metal deactivator, from 0.03 to 0.05% of the amide/amine additive mixture of the present invention indicated in the following table, and the remainder is oil.

TABLE I

| Lubricants G–P | Product of | Amide/Amine Amount (%/w) |
|---|---|---|
| G | Example 1 | 0.05 |
| H | Example 1 | 0.03 |
| I | Example 2 | 0.05 |
| J | Example 2 | 0.03 |
| K | Example 3 | 0.05 |
| L | Example 3 | 0.03 |
| M | Example 4 | 0.05 |
| N | Example 4 | 0.03 |
| O | Unamide ™ C-73-2 | 0.05 |
| P | Unamide ™ C-73-2 | 0.03 |

Lubricants Q-X

In Examples Q-X, the hydraulic fluid composition contains 0.53% of zinc di-(2-ethylhexyl) dithiophosphate antiwear agent, 0.18% of a hindered phenol antioxidant (ethyl antioxidant 733), 0.008% tolad 370 as a demulsifier, 0.07% of a sulfur coupled calcium phenate antioxidant, 0.001% of tolyl triazole metal deactivator, amide/amine mixtures in accordance with the present invention in amounts indicated in the following Table II and the remainder is mineral oil.

TABLE II

| Lubricants Q–X | Product of | Amide/Amine Amount (%/w) |
|---|---|---|
| Q | Example 1 | 0.05 |
| R | Example 1 | 0.03 |
| S | Example 2 | 0.03 |
| T | Example 3 | 0.03 |
| U | Example 4 | 0.03 |
| V | Unamide ™ C-73-2 | 0.03 |
| W | Unamide ™ C-73-2 | 0.02 |
| X | Unamide ™ C-73-2 | 0.01 |

While the invention has been explained In relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A composition comprising at least about 70% by weight of an oil of lubricating viscosity and an amount effective to inhibit metal corrosion of a soluble additive mixture comprising (A) at least one amide compound derived from a mono- or polycarboxylic acid or reactive derivative of said mono- or polycarboxylic acid and at least one alkanolamine; and (B) at least about 0.5 mole of at least one amine per mole of amide wherein the lubricating composition is substantially non-aqueous.

2. The composition of claim 1 wherein the amine (B) is characterized by at least one of the formulae $$R^5R^6NH \quad (IV)$$

$$H(N(X)\text{-}Alk\text{-})_aNH_2 \quad (V)$$

wherein $R^5$, $R^6$ and X are each independently hydrogen or hydrocarbyl, aminohydrocarbyl, hydroxyhydrocarbyl or heterocyclic-substituted hydrocarbyl groups containing up to about 10 carbon atoms provided that both $R^5$ and $R^6$ are not hydrogen; Alk is an alkylene group containing up to about 10 carbon atoms; and a is 2 to about 10.

3. The composition of claim 2 wherein $R^5$ and $R^6$ are hydroxyhydrocarbyl groups.

4. The composition of claim 2 wherein $R^5$ and $R^6$ are aminohydrocarbyl groups.

5. The composition of claim 1 wherein the composition comprises at least about 0.001% by weight of the additive mixture.

6. The composition of claim 1 wherein additive mixture is prepared by reacting at least one mono- or polycarboxylic acid of the formula $R[COOH]_n$, or reactive derivative of said mono- or polycarboxylic acid, and wherein n is 1, 2 or 3, and R is a hydrocarbyl group containing from about 6 to about 60 carbon atoms; with at least about 1.5 n moles, per mole of carboxylic acid, of at least one amine characterized by one or more of the formulae $$R^5R^6NH \quad (IV)$$

$$H(N(X)\text{-}Alk\text{-})_aNH_2 \quad (V)$$

wherein $R^5$, $R^6$ and X are each independently hydrogen or hydrocarbyl, aminohydrocarbyl, hydroxyhydrocarbyl or heterocyclic-substituted hydrocarbyl groups containing up to about 10 carbon atoms provided that both $R^5$ and $R^6$ are not hydrogen; Alk is an alkylene group containing up to about 10 carbon atoms; and a is 2 to about 10.

7. The composition of claim 6 wherein the reactive derivative of said mono- or polycarboxylic acid is an ester, amide, acid halide, anhydride, ketene or lactone of the mono- or polycarboxylic acid.

8. The composition of claim 6 wherein n=1 and one mole of carboxylic acid or reactive derivative of said carboxylic acid is reacted with from about 1.5 to about 2.5 moles of amine.

9. The composition of claim 6 wherein at least 95% of the carboxylic acid or reactive derivative of said carboxylic acid is reacted.

10. The composition of claim 6 wherein substantially all of the carboxylic acid or reactive derivative of said carboxylic acid is reacted.

11. The composition of claim 6 wherein the acid is a dicarboxylic acid selected from a hydrocarbyl-substituted dicarboxylic acids containing an average of about 8 to about 40 carbon atoms, and dimer acids containing from about 18 to about 44 carbon atoms.

12. The composition of claim 6 wherein n is 1 and R is a hydrocarbyl group containing an average of from 6 to about 38 carbon atoms.

13. The composition of claim 1 also containing from about 0.01 to about 2% by weight of at least one antiwear agent which is an ester or a salt of a dihydrocarbyldithiophosphoric acid, or mixtures thereof.

14. The composition of claim 13 wherein the antiwear agent is a zinc dialkylphosphorodithloate.

15. The composition of claim 1 also containing from about 0.0005 to about 0.5% by weight of at least one oxidation inhibitor.

16. The composition of claim 15 wherein the oxidation inhibitor is a hindered phenol, an aromatic amine, an alkyl polysulfide, a selenide, a borate, a dithiocarbamate a sulfurized metal phenate, or mixtures thereof.

17. The composition of claim 15 wherein the oxidation inhibitor is a sulfurized Group II metal phenate.

18. The composition of claim 1 also containing at least one metal deactivating compound which is a benzotriazole.

19. A process for the transmission of force hydraulically wherein a force is applied at one point in a hydraulic system and transmitted by a hydraulic fluid through the hydraulic system so as to produce a change in the direction or magnitude of that force, wherein the hydraulic system contains a hydraulic fluid of the composition of claim 1.

20. The lubricating composition of claim 1 wherein the lubricating composition is substantially free of water.

21. The lubricating composition of claim 1 wherein the lubricating composition contains less than about 0.5% water.

22. The lubricating composition of claim 1 wherein the amine is an aliphatic or cycloaliphatic amine.

23. A composition comprising at least 70% by weight of an oil of lubricating viscosity and an amount effective to inhibit metal corrosion of a soluble mixture comprising (A) at least one amide is characterized by one or more of the formulae $$R[C(O)NR^1R^2]_n \quad (I)$$

$$R[C(\overset{O}{\overset{\|}{}}\!\!-\!\!\overset{X}{\overset{|}{N}}\!\!-Alk)_aNH_2]_n \quad (II)$$

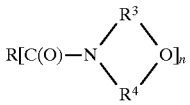

(III)

wherein R is a hydrocarbyl group containing from about 6 to about 90 carbon atoms; each of $R^1$, $R^2$, and X is independently hydrogen or a hydrocarbyl, aminohydrocarbyl, hydroxyhydrocarbyl or a heterocyclic-substituted hydrocarbyl group provided that for $R^1$ and $R^2$ (i) not hydrogen, (ii) one is hydrogen, or (iii) is hydroxyhydrocarbyl; each of $R^3$ and $R^4$ is, independently, a hydrocarbylene group containing up to about 10 carbon atoms; Alk is an alkylene group containing up to about 1 0 carbon atoms; a is an integer of from 2 to about 10; and n is 1, 2 or 3.

24. The composition of claim 23 wherein n is 1 and R contains 6 to 38 carbon atoms.

25. The composition of claim 23 wherein n is 2 or 3 and R contains from 8 to 90 carbon atoms.

26. The composition of claim 23 wherein none of $R^1$ and $R^2$ is hydrogen.

27. The composition of claim 23 wherein at least one of $R^1$ and $R^2$ is a hydroxyhydrocarbyl group.

28. The composition of claim 23 wherein $R^1$ and $R^2$ are hydroxyhydrocarbyl groups.

29. The composition of claim 23 wherein the amide is characterized by Formula I and n is 1.

30. The composition of claim 29 wherein the amine is characterized by Formula IV.

31. A composition comprising a major amount of an oil of lubricating viscosity and from about 0.005 to about 5% by weight of a soluble additive mixture comprising (A) at least one amide compound characterized by the formula $$R\text{-}C(O)NR^1R^2 \quad \text{(IA)}$$

wherein R is a hydrocarbyl group containing an average of about 12 to about 24 carbon atoms; and each of $R^1$ and $R^2$ is independently an aminohydrocarbyl or hydroxyhydrocarbyl group containing up to about 10 carbon atoms; and (B) from about 0.5 to about 1.5 moles of at least one amine per equivalent of amide wherein the amine is characterized by the formula $$R^5R^6NH \quad \text{(IV)}$$

wherein $R^5$ and $R^6$ are each independently an aminohydrocarbyl or hydroxyhydrocarbyl carbyl group containing up to about 10 carbon atoms.

32. The composition of 31 wherein $R^1$ is the same as $R^5$ and $R^2$ is the same as $R^6$.

33. The composition of claim 31 wherein $R^1$, $R^2$, $R^5$ and $R^6$ are hydroxyhydrocarbyl groups.

34. The composition of claim 33 wherein the hydroxyhydrocarbyl groups are hydroxyethyl groups.

35. The composition of claim 31 wherein the amide (A) is a fatty acid amide.

36. A process for the transmission of force hydraulically wherein a force is applied at one point in a hydraulic system and transmitted by a hydraulic fluid through the hydraulic system so as to produce a change in the direction or magnitude of that force, wherein the hydraulic system contains a hydraulic fluid of the composition of claim 34.

37. The lubricating composition of claim 31 wherein the lubricating composition is substantially nonaqueous.

38. A composition comprising a major amount of an oil of lubricating viscosity and from about 0.005 to about 5% by weight of a soluble nitrogen-containing additive obtained by reacting at least one carboxylic acid of the formula $$R[COOH]_n$$

or reactive derivative of said carboxylic acid wherein R is a hydrocarbyl group containing from about 6 to about 90 carbon atoms and n is 1, 2 or 3 with at least about 1.5n moles, per mole if carboxylic acid, of at least one amine characterized by one or more formulae $$R^5R^6NH \quad \text{(IV)}$$

$$H(N(X)\text{-}ALK\text{-})_aNH_2 \quad \text{(V)}$$

wherein $R^5$, $R^6$ and X are each independently hydrogen or hydrocarbyl, aminohydrocarbyl, hydroxyhydrocarbyl or heterocyclic-substituted hydrocarbyl groups containing up to about 1 0 carbon atoms provided that both $R^5$ and $R^6$ are not hydrogen and one is hydroxyhydrocarbyl; ALK is an alkylene group containing up to about 10 carbon atoms; and a is 2 to about 1 0, provided that when n =2 and the amine is an alkanolamine, more than 1.5 equivalents of amine are reacted per equivalent of carboxylic acid, wherein at least about 0.5 equivalent of the amine is present per mole of amide in the additive, wherein the lubricating composition is substantially non-aqueous.

39. The composition of claim 38 wherein the reactive derivative of said carboxylic acid is an ester, amide, acid halide, anhydride, ketene or lactone of the carboxylic acid.

40. The composition of claim 38 wherein one mole of carboxylic acid or reactive derivative of said carboxylic acid is reacted with from about 1.5 to about 2.5 moles of amine.

41. The composition of claim 38 wherein at least about 95% of the carboxylic acid or reactive derivative of said carboxylic acid is reacted.

42. The composition of claim 38 wherein substantially all of the carboxylic acid or reactive derivative of said carboxylic acid is reacted with the amine.

43. The composition of claim 38 wherein n is 1 and R is a hydrocarbyl group containing from 6 to about 30 carbon atoms.

44. The composition of claim 38 wherein the carboxylic acid is a fatty acid containing from 12 to about 24 carbon atoms.

45. The composition of claim 38 wherein $R^5$ and $R^6$ are not hydrogen.

46. The composition of claim 38 wherein $R^5$ and $R^6$ are each independently hydroxyhydrocarbyl or aminohydrocarbyl groups.

47. The composition of claim 38 wherein $R^5$ and $R^6$ are hydroxyalkyl groups.

48. A composition comprising at least about 70% by weight of an oil of lubricating viscosity and an amount effective to inhibit metal corrosion of a soluble additive mixture comprising (A) at least one amide compound derived from a mono- or polycarboxylic acid or reactive derivative of said mono- or polycarboxylic acid, wherein the amide is characterized by one or more of the formulae $$R[C(O)NR^1R^2]_n \quad \text{(I)}$$

$$R[C(\overset{O}{\overset{\|}{N}}\text{—}Alk)_a\overset{X}{\overset{|}{N}}H_2]_n \quad \text{(II)}$$

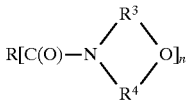

(III)

wherein R is a hydrocarbyl group containing from about 6 to about 90 carbon atoms; each of $R^1$, $R^2$, and X is independently hydrogen or a hydrocarbyl, aminohydrocarbyl, hydroxyhydrocarbyl or a heterocyclic-substituted hydrocarbyl group provided that both $R^1$ and $R^2$ are not hydrogen and one is hydrocarbyl each of $R^3$ and $R^4$ is, independently, a hydrocarbylene group containing up to about 10 carbon atoms; Alk is an alkylene group containing up to about 10 carbon atoms; a is an integer of from 2 to about 10; and n is 1.2 or 3; and (B) at least about 0.1 mole of an amine per mole of amide, wherein the amine is characterized by at least one of the formulae $$R^5R^6NH \quad \text{(IV)}$$

$$H(N(X)\text{-}ALK\text{-})_aNH_2 \quad \text{(V)}$$

wherein $R^5$, $R^6$ and X are each independently hydrogen or alkyl, aminoalkyl, hydroxyalkyl, or heterocyclic-substituted alkyl groups containing up to 10 carbon atoms provided that both $R^5$ and $R^6$ are not hydrogen; ALK is an alkylene group containing up to about 10 carbon atoms; and a is 2 to about 10 wherein the lubricating composition is substantially non-aqueous.

49. The composition of claim 48 wherein the composition comprises at least about 0.01% by weight of the additive mixture.

* * * * *